US012251647B1

(12) United States Patent
Race

(10) Patent No.: US 12,251,647 B1
(45) Date of Patent: Mar. 18, 2025

(54) CAPS, KITS, AND METHODS FOR PERFORMING A MAGIC TRICK

(71) Applicant: Penguin Magic, Inc., Rancho Cordova, CA (US)

(72) Inventor: Seth Race, Columbus, OH (US)

(73) Assignee: Penguin Magic, Inc., Rancho Cordova, CA (US)

( * ) Notice: Subject to any disclaimer, the term of this patent is extended or adjusted under 35 U.S.C. 154(b) by 0 days.

(21) Appl. No.: 18/821,444

(22) Filed: Aug. 30, 2024

(51) Int. Cl.
*A63J 21/00* (2006.01)
*A63J 15/00* (2006.01)

(52) U.S. Cl.
CPC ..... *A63J 21/00* (2013.01)

(58) Field of Classification Search
CPC ..... A63J 5/00; A63J 5/12; A63J 21/00; A63J 15/00; B65D 23/12; B65D 41/04; B65D 51/24
USPC ..... 472/57, 70, 71
See application file for complete search history.

(56) References Cited

U.S. PATENT DOCUMENTS 2,199,818 A * 5/1940 Franke ..... A63J 21/00 273/153 R
2,498,298 A * 2/1950 Renz ..... A63J 21/00 206/0.8
3,455,548 A * 7/1969 Lynch ..... A63J 15/00 472/57
3,822,879 A * 7/1974 Guitar ..... A63J 21/00 472/72

* cited by examiner

*Primary Examiner* — Kien T Nguyen
(74) *Attorney, Agent, or Firm* — POLSINELLI PC

(57) ABSTRACT

A cap, a magic kit, and methods for performing a magic trick are described. The cap can include a circular top end having an interior surface and an exterior surface, a side wall extending radially from the circular top end, an open bottom end, a thread on a side wall interior surface, a groove proximal the interior surface of the circular top end and a portion of the side wall, and a marker. The cap may be used to perform a magic trick where the groove retains a coin in the cap when the cap is flipped over.

20 Claims, 5 Drawing Sheets

CAPS, KITS, AND METHODS FOR PERFORMING A MAGIC TRICK

FIELD

The present disclosure relates generally to a cap for performing a magic trick. In at least one example, the cap has a circular top end, a side wall, an open bottom end, a thread extending radially inward from the side wall, a groove proximal to an interior surface of the top end and a portion of the side wall, and a marker.

BACKGROUND

Magicians often perform magic tricks in close proximity to observers. The magician may want to have a bottle cap that appears to be a normal bottle cap but is actually operable to hold one or more coins. For example, a magician may want a bottle cap that can conceal and retain a coin against the effects of gravity while other coins fall out of the open end of the cap. However, bottle caps operable to conceal and retain a coin against the effects of gravity are not known in the art.

As presented herein, a cap, kits, and methods have been developed to overcome these problems.

BRIEF SUMMARY

Provided herein is a cap for performing a magic trick. The cap can include a circular top end having an interior surface and an exterior surface, a side wall extending radially from the circular top end, an open bottom end, a thread on a side wall interior surface extending radially inward from the side wall between the interior surface of the circular top end and the open bottom end, a groove proximal the interior surface of the circular top end and a portion of the side wall, and a marker proximal the open bottom end and on the side wall. In an aspect, the marker marks the location of the groove. In another aspect, the cap is sized to fit one or more coins. In an aspect, the groove is operable to retain at least one of the one or more coins when the cap is flipped about 180 degrees. In an aspect, the groove is operable to retain at least one or the one or more coins when the cap is flipped when the marker is positioned at a 5 o'clock position in a hand of a user.

In various aspects, the one or more coins are pennies, nickels, dimes, quarters, or any other coin. In an aspect, the cap is operable to removably couple to a bottle. In an aspect, the groove is defined by the interior surface of the circular top end, the portion of the side wall, and a first portion of the thread having a substantially constant height from the interior surface of the circular top end. In an aspect, the groove does not extend along an entire circumference of the side wall. In an aspect, the substantially constant height is about 1.5 mm to about 2 mm. In an aspect, the marker is an end of the thread.

Further provided herein is a kit for performing a magic trick. The kit can include a circular top end having an interior surface and an exterior surface, a side wall extending radially from the circular top end, an open bottom end, a thread on a side wall interior surface extending radially inward from the side wall between the interior surface of the circular top end and a portion of the side wall, and a marker proximal the open bottom end and on the side wall. In an aspect, the marker marks a location of the groove. In an aspect, the kit further includes one or more coins operable to fit in the cap.

In various aspects, the groove retains at least one of the one or more coins when the cap is flipped about 180 degrees. In an aspect, the groove retains at least one coin of the one or more coins when the cap is flipped when the marker is positioned at a 5 o'clock position in a hand of a user. In an aspect, the cap is operable to removably couple to a bottle. In an aspect, the one or more coins are pennies, nickels, dimes, quarters, or any other coin. In an aspect, the kit further includes a packaging. In an aspect, the groove is defined by the interior surface of the circular top end, the portion of the side wall, and a first portion of the thread having a substantially constant height from the interior surface of the circular top end. In an aspect, the groove does not extend along an entire circumference of the side wall. In an aspect, the substantially constant height is about 1.5 mm to about 2 mm. In an aspect, the marker is an end of the thread.

Further provided herein is a method for performing a magic trick. The method can include placing a first coin and one or more additional coins in a cap, aligning a marker at a 5 o'clock position in a hand of a user, sliding the first coin into a groove proximal an interior surface of a top end of the cap, and flipping the cap about 180 degrees. In an aspect, the first coin in the groove is retained in the cap. In an aspect, the one or more additional coins fall out of an open bottom surface of the cap. In an aspect, the method can further include instructing an observer to place a hand under the cap prior to flipping the cap about 180 degrees, allowing the one or more additional coins to fall into the hand of the observer, and asking the observer to count the one or more additional coins.

Other aspects and iterations of the invention are described more thoroughly below.

BRIEF DESCRIPTION OF THE DRAWINGS

Implementations of the present technology will now be described, by way of example only, with reference to the attached figures, wherein.

DETAILED DESCRIPTION

Figure 1A:
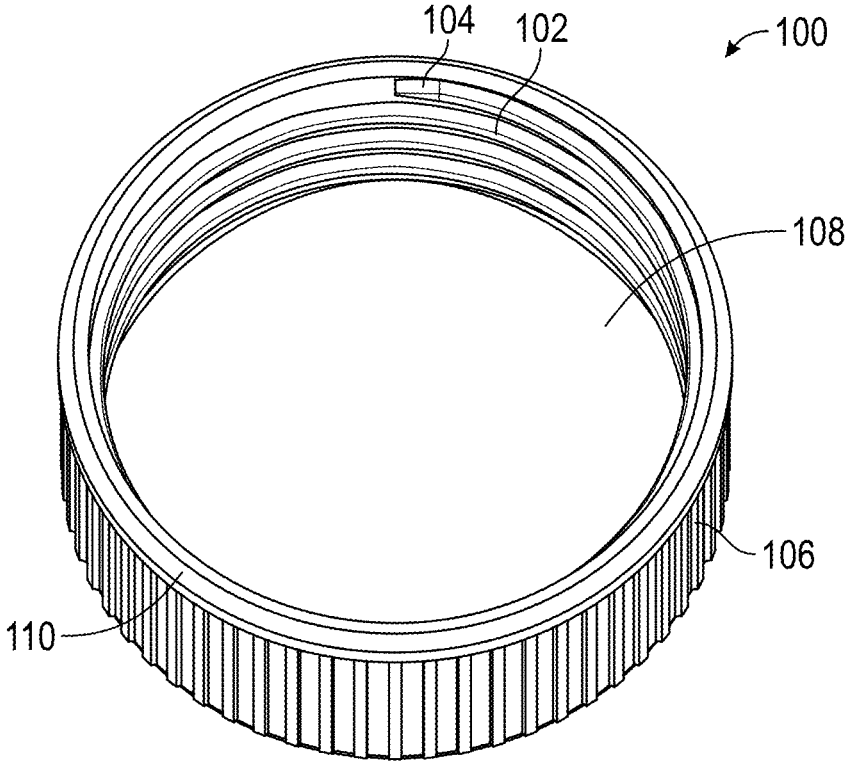
FIG. 1A is an isometric bottom view of a cap for performing a magic trick in one example.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout the above disclosure will now be presented. As used herein, "about" refers to numeric values, including whole numbers, fractions, percentages, etc., whether or not explicitly indicated. The term "about" generally refers to a range of numerical values, for instance, ±0.5-1%, ±1-5% or ±5-10% of the recited value, that one would consider equivalent to the recited value, for example, having the same function or result.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, "substantially cylindrical" means that the object resembles a cylinder but can have one or more deviations from a true cylinder.

The terms "comprising," "including" and "having" are used interchangeably in this disclosure. The terms "comprising," "including" and "having" mean to include, but not necessarily be limited to the things so described.

Provided herein is a cap for use in magic tricks. When performing magic tricks in close proximity to observers, it is often desirable to have props that can be moved into different configurations without an observer noticing how the props move between configurations. Further, it is often desirable to have props that can hide various objects without an observer realizing the objects have been hidden. For example, a magician may want to have a cap that is operable to hold a coin or other object against the force of gravity. The magician may want a cap that appears to be a normal bottle cap but has a mechanism (e.g., groove) for retaining a coin when the bottle cap is flipped over (e.g., from a top end facing the ground to an open bottom end facing the ground). A magician can make a coin appear to disappear to an observer when a coin is placed in the cap, the cap is flipped over, and the coin does not fall out as expected. Notably, conventional bottle caps are designed to permanently seal bottles such that liquid does not spill out. Conventional bottle caps have a uniform thread (e.g., uniform slope) and corresponding uniform grooves (e.g., uniform depth) such that the conventional bottle cap seals with the corresponding grooves and threads of a bottle. However, due to the uniform slope of the thread and the uniform depth of the grooves, convention bottle caps are not operable to retain coins. Provided herein is a cap for retaining a coin that can have a non-uniform thread slope and/or grooves with non-uniform depths.

Figure 1B:
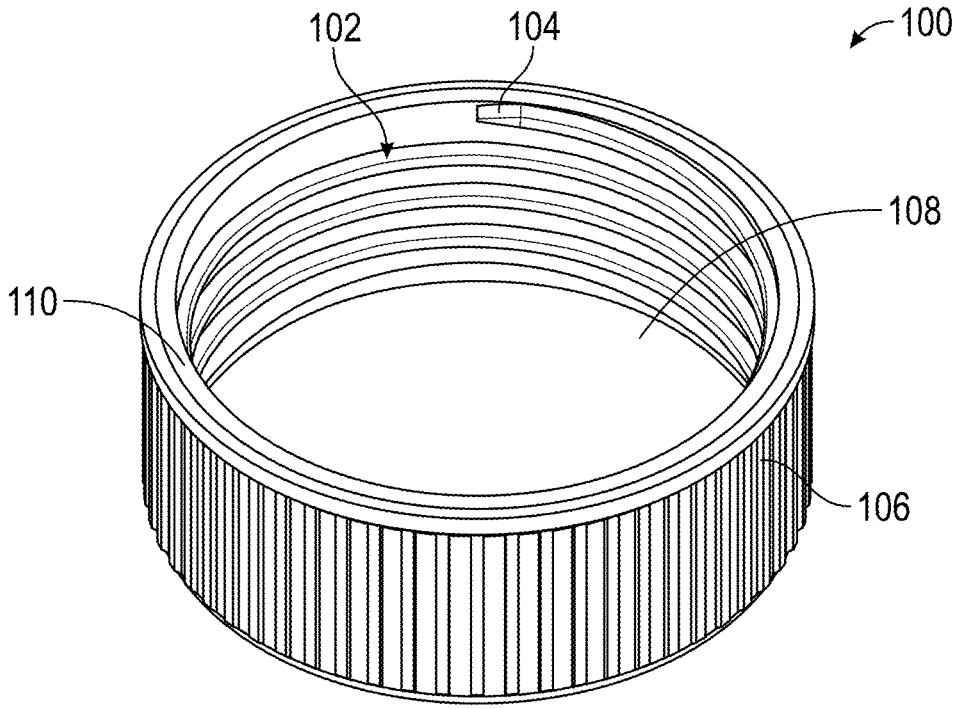
FIG. 1B is an isometric bottom view of a cap for performing a magic trick in one example.
Figure 3:
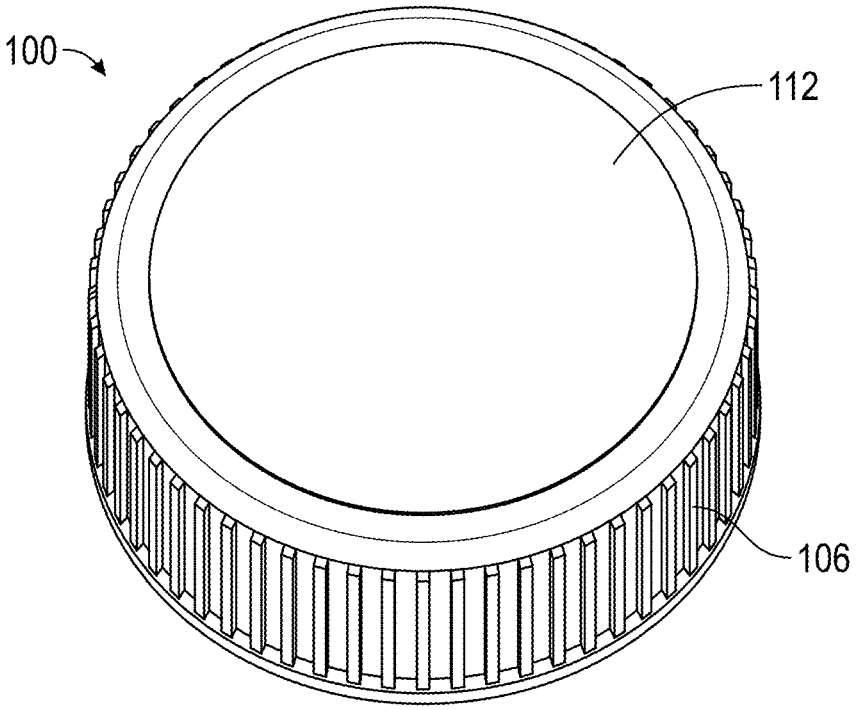
FIG. 3 is an isometric top view of a cap for performing a magic trick in one example.

As illustrated in FIGS. 1A-1B and 3, the cap 100 can have a thread 102, a marker 104, a top end having an interior surface 108 and an exterior surface 112, a side wall 106, and an open bottom end 110. The side wall 106 can extend radially from the circular top end. The open bottom end 110 is the opening created by the end of the side wall 106. The thread 102 can extend radially inward from the side wall 106 between the interior surface 108 and the open bottom end 110. The thread 102 can start at a constant height from the interior surface 108 of the circular top end and then slope upwards around the side wall 106 toward the open bottom end 110. The marker 104 can be located proximal the open bottom end 110 on the side wall 106. The marker 104 can mark the location of a coin holding mechanism (e.g., groove). The marker 104 can be an end of the thread 102.

Figure 2A:
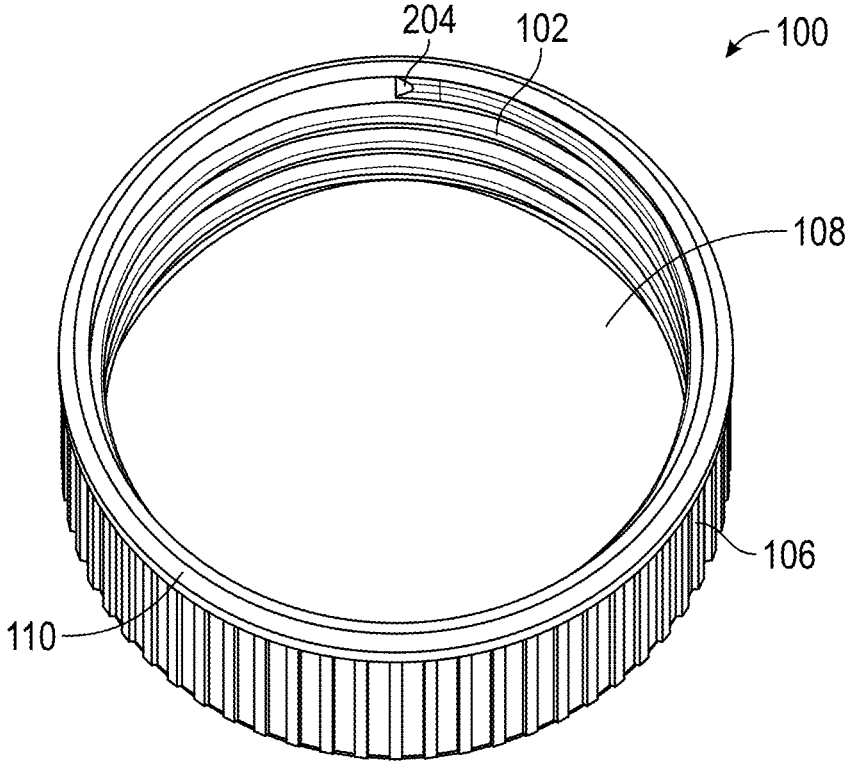
FIG. 2A is an isometric bottom view of a cap for performing a magic trick in one example.
Figure 2B:
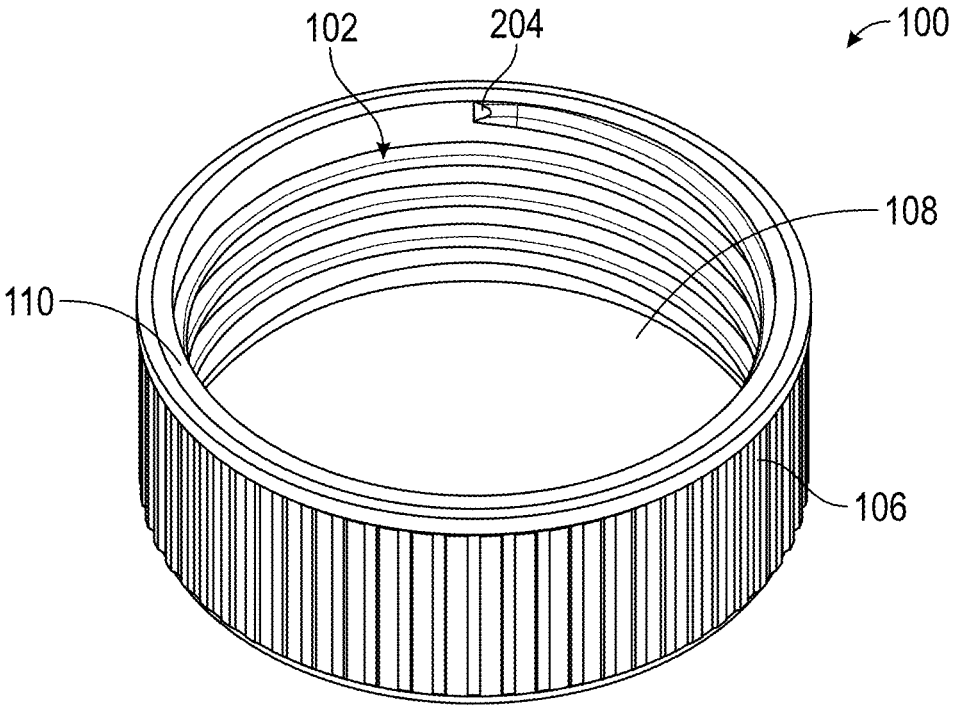
FIG. 2B is an isometric bottom view of a cap for performing a magic trick in one example.

FIGS. 1A-1B illustrate a shape of the marker 104 in a first example. FIGS. 2A-2B illustrate a shape of a marker 204 in another example. It will be appreciated that other marker shapes can be used other than marker 104 and marker 204.

In some aspects, the cap 100 can appear to be a normal bottle cap. The external appearance as a normal bottle cap allows the cap 100 to be used in a magic trick to deceive the observer in believing they are seeing a normal bottle cap. For example, the cap 100 can appear to be a soda bottle cap, a beer bottle cap, a milk jug cap, or any other kind of bottle cap. In some examples, the thread 102 of the cap 100 can be configured removably couple to corresponding threads of a bottle. In an example, the cap 100 can seal the bottle or partially seal the bottle.

In an aspect, the cap 100 can have a plurality of ridges on the exterior surface of the side wall 106. The plurality of ridges can be operable to provide increased grip of the cap 100.

Figure 4:
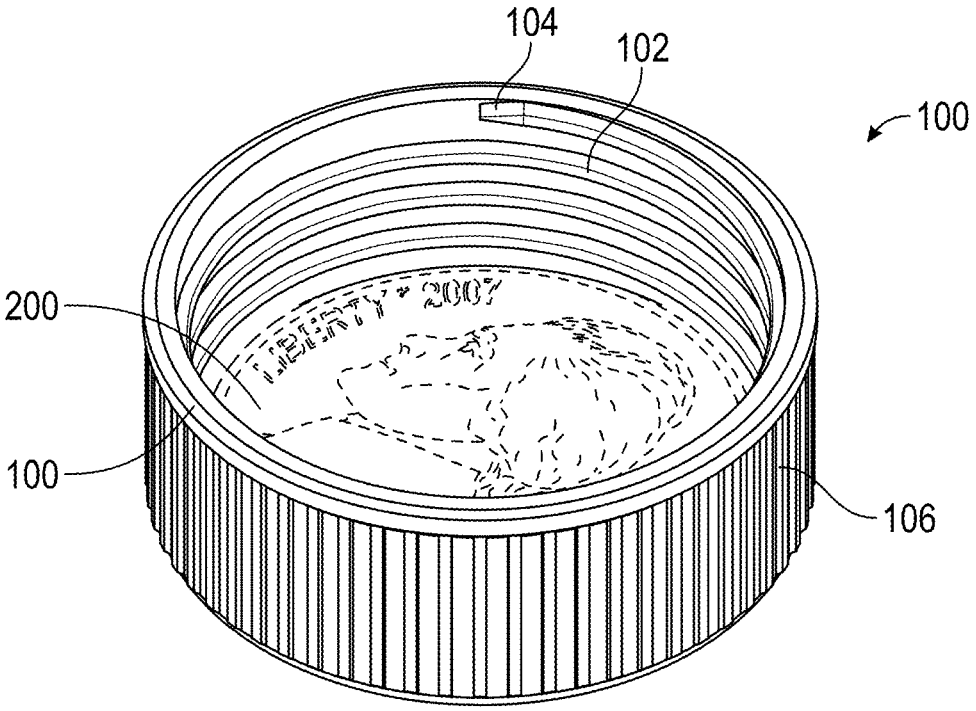
FIG. 4 is an isometric bottom view of a cap holding a coin in one example.

As illustrated in FIG. 4, the cap 100 can be operable to hold one or more coins 200. The cap 100 can be sized to hold coins such as but not limited to pennies, nickels, dimes, quarters, half dollars, Euros, pounds, pence, any foreign (non-US) coin currency, or other coins known in the art. In other examples, the cap 100 can be sized to hold coin-shaped items such as poker chips, fake money, metal tokens, paper tokens, plastic tokens, or other items that are shaped like a coin or flat cylinders. The one or more coins 200 can be one, two, three, four, five, six, seven, eight, nine, ten or more coins depending on the height of the side wall 106. In some examples, the one or more coins 200 can fit loosely inside the cap 100 and can lie on the interior surface 108 of the circular top end of the cap 100.

Figure 5A:
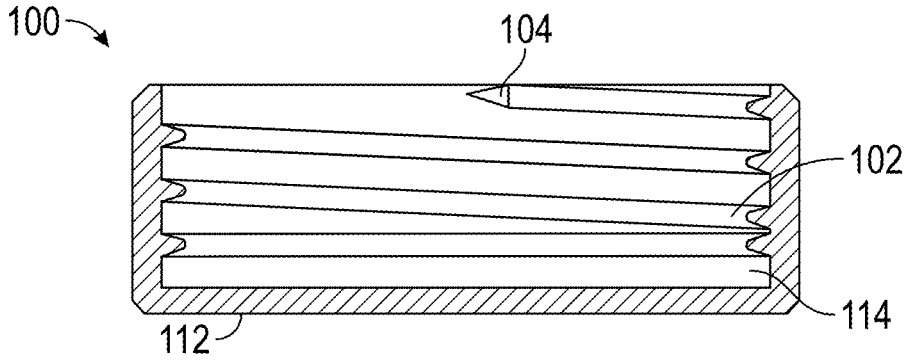
FIG. 5A is a cross sectional view of a cap for performing a magic trick in one example.
Figure 5B:
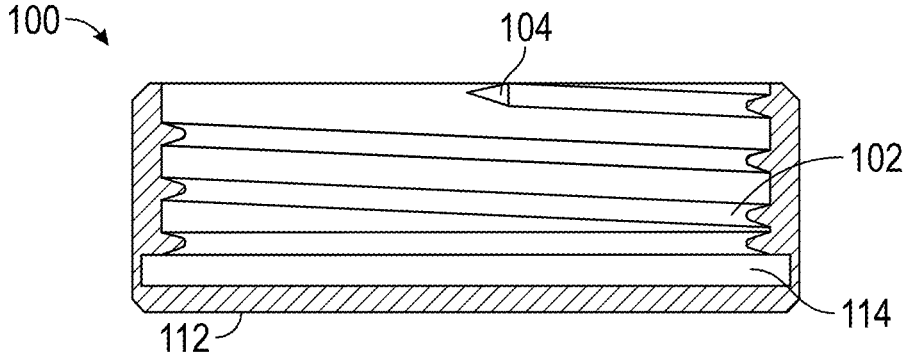
FIG. 5B is a cross sectional view of a cap for performing a magic trick in one example.

As illustrated in FIGS. 5A-B, the cap 100 can include a groove 114. As illustrated in FIG. 5A, the groove 114 can be defined by a first portion 116 of the thread 102, the interior surface 108 of the circular top end, and a portion of the side wall 106. The groove 114 can be configured to retain at least one coin when the cap is flipped over such that the open bottom end 110 is facing the ground. The groove 114 can retain the coin despite the gravitational force on the coin. In some examples, the coin to be retained by the groove 114 must be slid into the groove 114 such that an edge of the coin is touching the portion of the side wall 106 that defines the groove 114. The groove 114 can hold a portion of the coin and provide a sufficient force to overcome the gravitational force on the coin. The first portion 116 of the thread 102 creates a lip and provides a sufficient retaining force to prevent the coin from falling out of the open bottom end 110 of the cap 100. The first portion 116 of the thread 102 has a substantially constant height (e.g., distance) from the interior surface of 108 of the circular top end, thereby providing the groove 114 with a substantially constant height throughout the length of the groove 114.

In an aspect, the groove 114 extends around an entire circumference of the side wall 106 such that the coin can be slid into the groove 114 in any location on the side wall 106. In another example, the groove 114 only extends around a portion of the circumference of the side wall 106. For example, the groove 114 can extend for about 10% to about 20%, about 20% to about 30%, about 30% to about 40%, about 40% to about 50%, about 50% to about 60%, about 60% to about 70%, about 70% to about 80%, about 80% to about 90%, or more of the circumference of the side wall 106. Since the groove 114 is defined by the first portion 116 of the thread 102 having a substantially constant height from the interior surface 108 of the circular top end, the first portion 116 of the thread 102 extends around the same percentage of the circumference of the side wall 106 as the groove 114.

In some aspects, the substantially constant height of the first portion 116 of the thread 102, and thereby the height of the groove 114, is sized such that it is only slightly larger than a thickness of the coin to be retained. For example, the substantially constant height can be about 1 mm to about 1.5 mm, about 1.5 mm to about 2 mm, about 2 mm to about 2.5 mm, or about 2 mm to about 3 mm. In another example, the substantially constant height can be about 1.3 mm to about 1.4 mm, about 1.4 mm to about 1.5 mm, about 1.5 mm to about 1.6 mm, about 1.6 mm to about 1.7 mm, about 1.7 mm to about 1.8 mm, about 1.8 mm to about 1.9 mm, about 1.9 mm to about 2 mm, about 2 mm to about 2.1 mm, about 2.1 mm to about 2.2 mm, about 2.2 mm to about 2.3 mm, about 2.3 mm to about 2.4 mm, about 2.4 mm to about 2.5 mm, about 2.5 mm to about 2.6 mm, about 2.6 mm to about 2.7 mm, about 2.7 mm to about 2.8 mm, about 2.8 mm to about 2.9 mm, or about 2.9 mm to about 3 mm. In an example, the substantially constant height can be about 1.3 mm to about 1.35 mm, about 1.35 mm to about 1.4 mm, about 1.4 mm to about 1.45 mm, about 1.45 mm to about 1.5 mm, about 1.5 mm to about 1.55 mm, about 1.55 mm to about 1.6 mm, about 1.6 mm to about 1.65 mm, about 1.65 mm to about 1.7 mm, about 1.7 mm to about 1.75 mm, about 1.75 mm to about 1.8 mm, about 1.8 mm to about 1.85 mm, about 1.85 mm to about 1.9 mm, about 1.9 mm to about 1.95 mm, about 1.95 mm to about 2 mm, about 2 mm to about 2.05 mm, about 2.05 mm to about 2.1 mm, about 2.1 mm to about 2.15 mm, about 2.15 mm to about 2.2 mm, about 2.2 mm to about 2.25 mm, about 2.25 mm to about 2.3 mm, about 2.3 mm to about 2.35 mm, about 2.35 mm to about 2.4 mm, about 2.4 mm to about 2.45 mm, about 2.45 mm to about 2.5 mm, about 2.5 mm to about 2.55 mm, about 2.55 mm to about 2.6 mm, about 2.6 mm to about 2.65 mm, about 2.65 mm to about 2.7 mm, about 2.7 mm to about 2.75 mm, about 2.75 mm to about 2.8 mm, about 2.8 mm to about 2.85 mm, about 2.85 mm to about 2.9 mm, about 2.95 mm to about 3.0 mm. In some examples, the substantially constant height can be about 0.01 mm to about 0.1 mm, about 0.1 mm to about 0.2 mm, about 0.2 mm to about 0.3 mm, about 0.3 mm to about 0.4 mm, or about 0.4 mm to about 0.5 mm larger than the thickness of the coin to be retained in the groove 114.

In another aspect, the groove 114 can be operable to hold more than one coin. For example, the groove can hold two, three, four, or more coins. The substantially constant height can be adjusted such that the groove 114 is sized to hold more than one coin.

As illustrated in FIG. 5B, the groove 114 can extend further into the side wall 106 than the other grooves created by the thread 102, thereby creating the groove 114 with a greater depth and greater volume than the other grooves created by the thread 102. In some examples, the groove 114 can extend into the side wall 106 about 0.01 mm to about 0.05 mm, about 0.05 mm to about 0.1 mm, about 0.1 mm to about 0.15 mm, about 0.15 mm to about 0.2 mm, about 0.2 mm to about 0.25 mm, about 0.25 mm to about 0.3 mm, about 0.3 mm to about 0.35 mm, about 0.35 mm to about 0.4 mm, about 0.4 mm to about 0.45 mm, or about 0.45 mm to about 0.5 mm more than the other grooves created by the thread 102. The greater depth of the groove 114 allows the groove 114 to provide the necessary retaining force to the portion of the coin to overcome the gravitational force on the coin when the cap is flipped (e.g., with the open bottom end 110 facing the ground).

In some aspects, the first portion 116 of the thread 102 can extend further inward (e.g., towards the center of the cap 100) than the remaining portions of the thread 102. By extending further inward than the remaining portions of the thread 102, the first portion 116 of the thread 102 can create a lip operable to retain the coin when the cap 100 is flipped over. For example, the first portion 116 of the thread 102 can extend inward about 0.01 mm to about 0.05 mm or about 0.05 to about 0.1 mm more than the remaining portions of the thread, thereby giving the groove 114 a larger volume than the other grooves created by the remaining portions of the thread 102.

Figure 6:
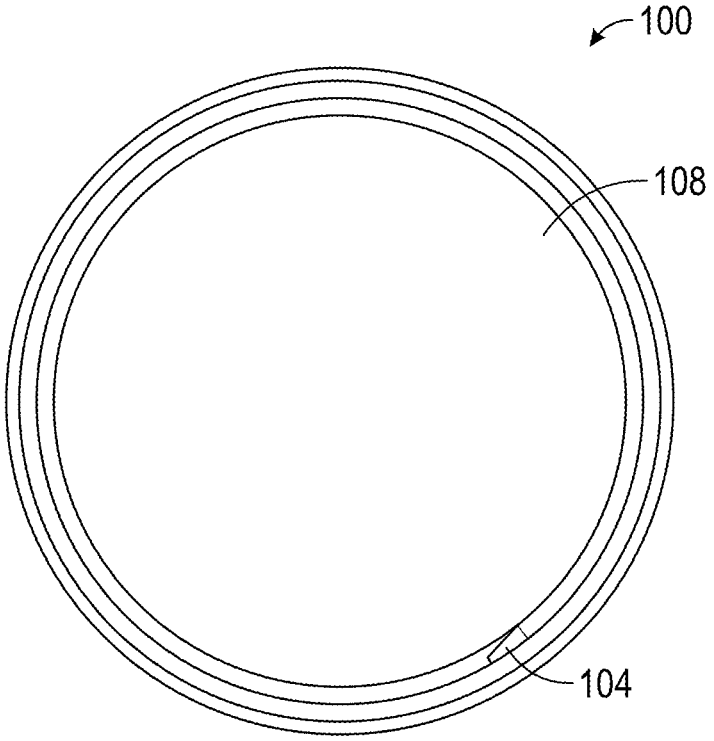
FIG. 6 is a top view of a cap for performing a magic trick in one example.

As illustrated in FIGS. 5A-6, the marker 104 can mark the location of the groove 114. In some examples, the marker 104 can be an end of the thread 102 located near the open bottom end 110 on the side wall 106. In other examples, the marker 104 can be any other kind of object or text configured to mark a location. For example, the marker can be a slot cut into the side wall 106 at the open bottom end 110 or a marking (e.g., arrow, star, other shape, or text) on the interior surface 108 of the circular top end.

In some aspects, the marker 104 can be offset from the exact location of the groove 114. In an example, the marker 104 can be used to locate the groove 114 by rotating the cap 100 such that the marker 104 is in a certain position. When the marker 104 is located in a certain position, the groove 114 can be located in the portion of the side wall 106 closest to the user. For example, as illustrated in FIG. 6, the marker can be placed in a 5 o'clock position when viewed by a user. The groove 114 can be located to the left of the marker 104. The groove 114 can extend from a 7 o'clock position to a 5 o'clock position in the configuration shown in FIG. 6.

Other orientations of the marker 104 can be used. For example, the marker 104 can indicate that the groove 114 is directly below the marker 104, as illustrated in FIGS. 5A-5B. In other examples, the marker 104 can be located directly across from the groove 114. In another example, the marker 104 can be placed in any position in relation to the location of the groove 114. For example, the marker 104 can be configured to be located in the 1 o'clock, 2 o'clock, 3 o'clock, 4 o'clock, 5 o'clock, 6 o'clock, 7 o'clock, 8 o'clock, 9 o'clock, 10 o'clock, 11 o'clock, or 12 o'clock position to indicate that the groove 114 is located on the portion of the side wall 106 closest to the user. It will be appreciated that any location of the marker 104 can indicate a corresponding location of the groove 114, so long as the user knows the relationship between the location of the marker 104 and the location of the groove 114.

To perform a magic trick, a coin is placed on the interior surface 108 of the top end when the top end is facing the ground. The coin is then properly inserted into the groove 114. For example, as illustrated in FIG. 6, the user can locate the groove 114 by placing the marker 104 in the 5 o'clock position. The user can then slide the coin into the groove 114 located between the 5 o'clock position and the 7 o'clock position by either using their finger to slide the coin into the groove 114 or by shaking the cap 100 until the edge of the coin is within the groove 114. The user can then rotate the cap 100 about 180 degrees (e.g., the marker 104 goes from the 5 o'clock facing away from the ground to the 1 o'clock position facing the ground). The groove 114 retains the coin in the cap 100 and the coin does not fall out. An observer may be surprised that the coin has seemingly disappeared.

In another aspect, multiple coins can be placed on the interior surface 108 of the circular top end of the cap 100. For example, one, two, three, four, or more coins can be placed on the interior surface 108 of the circular top end of the cap 100. A first coin (e.g., the coin placed directly on the interior surface 108) can be slid into the groove 114. Due to the size of the groove 114, the remaining coins do not fit into the groove 114. When the cap is flipped 180 degrees, the first coin is retained in the groove 114 while the remaining coins fall out of the open bottom end 110. An observer may be surprised that one of the coins has seemingly disappeared. A user can than shake the cap 100 such that the coin that was retained in the groove 114 falls out. The observer may be surprised that the user is able to make the coin reappear.

Further provided herein is a magic kit. The magic kit can include the cap 100. In some examples, the magic kit can further include a packaging operable to hold the cap 100. In some examples, the packaging can be a container, a bag, or any other packaging operable to hold the cap 100. In some examples, the magic kit can include two or more caps. In another example, the magic kit can further include one, two, three, four, five, six, seven, eight, nine, ten, or more coins operable to be held in the groove 114 of the cap 100.

Figure 7:
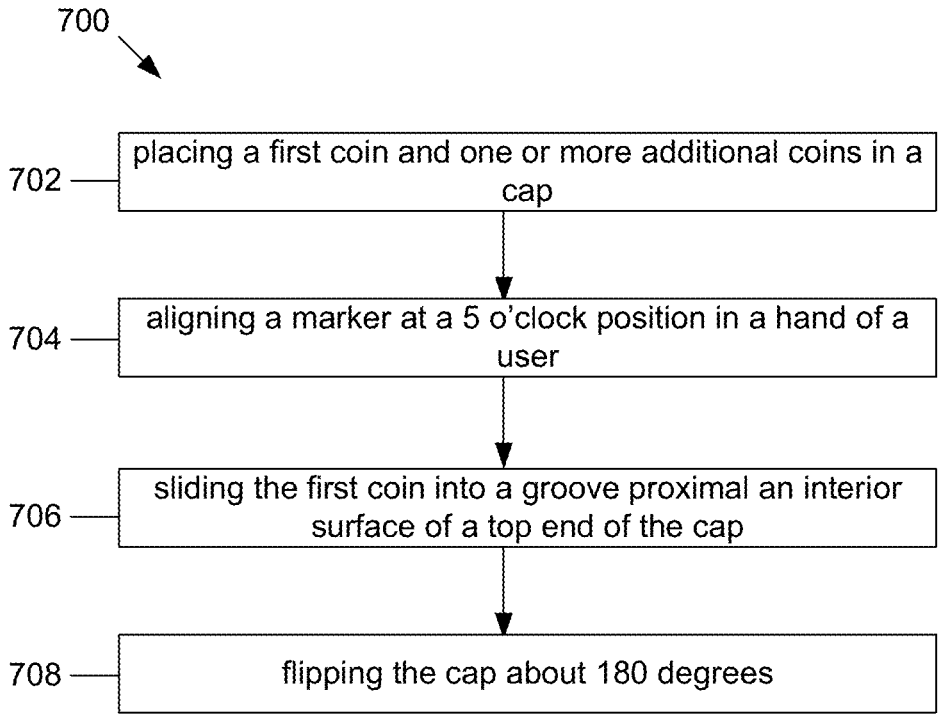
FIG. 7 is a flowchart of a method for performing a magic trick in one example.

Further provided herein is a method for performing a magic trick. The method can be conducted using the caps and magic kits described herein. As illustrated in FIG. 7, the method 700 can include multiple steps. The method can begin at block 702. At block 702, the method 700 can include placing a first coin and one or more additional coins in a cap. The first coin can be placed on the interior surface of a circular top end of the cap. The one or more additional coins can be placed on top of the first coin.

At block 704, the method 700 can include aligning a marker at a 5 o'clock position in a hand of a user (e.g., when the user is looking down at the interior surface of the circular top end of the cap the marker should be in the 5 o'clock position). The marker can be an end of a thread extending radially inward from a side wall of the cap. The marker can mark the location of a groove in the cap that can be used to retain the first coin. For example, when the marker is properly positioned, the user can know that the groove is located in a portion of the side wall closest to the user.

At block 706, the method 700 can include sliding the first coin into the groove. The groove can be proximal to an interior surface of the top end of the cap. The groove can be defined by a first portion of a thread, a portion of the side wall of the cap, and the interior surface of the top end of the cap. The first portion of the tread can have a substantially constant height from the interior surface of the circular top end of the cap. The substantially constant height can be slightly larger than the thickness of the first coin such that the first coin can be slid into the groove but also retained by the groove when the cap is flipped over (e.g., flipped 180 degrees). In some examples, the groove can have a depth (e.g., distance into the side wall) that is greater than any other depth created by the thread at other points in the side wall. The first portion of the thread can also extend further inward (e.g., towards the center of the cap) than the remaining portions of the thread. The user can slide the first coin into the groove by shaking the cap until an edge of the first coin slides up against the portion of the side wall defining the groove.

At block 708, the method 700 can include flipping the cap about 180 degrees. Flipping the cap 180 degrees can include rotating the cap such that the open bottom end goes from facing away from the ground to facing the ground. When the cap is flipped 180 degrees, the first coin is retained within the groove. The one or more additional coins are not retained by the groove and fall out of the open bottom surface of the cap. An observer may be surprised that the first coin has seemingly disappeared.

In an aspect, the method can further include instructing an observer to place a hand under the cap prior to flipping the cap about 180 degrees. The cap can then be flipped and the user can allow the one or more additional coins to fall into the hand of the observer. The method can further include asking the observer to count the one or more additional coins. The observer may be surprised that the first coin is seemingly missing. In some examples, the method can include asking the observer to count the first coin and the one or more additional coins before placing the first coin and the one or more additional coins in the cap. In other examples, the user may show the observer the first coin and the one or more additional coins before placing the first coin and the one or more additional coins in the cap.

In some aspects, the method can further include using sleight of hand to make the first coin reappear. For example, the user may shake the cap such that the first coin comes out of the groove and falls out of the open bottom end. The user can hide the shake of the cap from the observer, catch the first coin without the observer seeing, and make the first coin seemingly reappear from different locations, such as from behind the observer's ear. It will be appreciated that other magic tricks can be performed utilizing the above method. For example, any kind of magic trick where a coin appears to disappear from within a cap and then reappear at a later time can be accomplished using the method described herein.

The disclosures shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

What is claimed is:

1. A cap for performing a magic trick, the cap comprising:
- a circular top end having an interior surface and an exterior surface;
- a side wall extending radially from the circular top end;
- an open bottom end;
- a thread on a side wall interior surface extending radially inward from the side wall between the interior surface of the circular top end and the open bottom end;
- a groove proximal the interior surface of the circular top end and a portion of the side wall; and
- a marker proximal the open bottom end and on the side wall, wherein the marker marks a location of the groove.

2. The cap of claim 1, wherein the cap is sized to fit one or more coins.

3. The cap of claim 2, wherein the groove is operable to retain at least one of the one or more coins when the cap is flipped about 180 degrees.

4. The cap of claim 3, wherein the groove is operable to retain at least one of the one or more coins when the cap is flipped when the marker is positioned at a 5 o'clock position in a hand of a user.

5. The cap of claim 2, wherein the one or more coins are pennies, nickels, dimes, or quarters.

6. The cap of claim 1, wherein the cap is operable to removably couple to a bottle.

7. The cap of claim 1, wherein the groove is defined by the interior surface of the circular top end, the portion of the side wall, and a first portion of the thread having a substantially constant height from the interior surface of the circular top end, and wherein the groove does not extend along an entire circumference of the side wall.

8. The cap of claim 7, wherein the substantially constant height is about 1.5 mm to about 2 mm.

9. The cap of claim 1, wherein the marker is an end of the thread.

10. A kit for performing a magic trick, the kit comprising:

a cap comprising:

a circular top end having an interior surface and an exterior surface;

a side wall extending radially from the circular top end;

an open bottom end;

a thread on a side wall interior surface extending radially inward from the side wall between the interior surface of the circular top end and the open bottom end;

a groove proximal the interior surface of the circular top end and a portion of the side wall; and a marker proximal the open bottom end and on the side wall, wherein the marker marks a location of the groove; and one or more coins operable to fit in the cap.

11. The kit of claim 10, wherein the groove retains at least one of the one or more coins when the cap is flipped about 180 degrees.

12. The kit of claim 11, wherein the groove retains at least one coin of the one or more coins when the cap is flipped when the marker is positioned at a 5 o'clock position in a hand of a user.

13. The kit of claim 10, wherein the cap is operable to removably couple to a bottle.

14. The kit of claim 10, wherein the one or more coins are pennies, nickels, dimes, or quarters.

15. The kit of claim 10, the kit further comprising a packaging.

16. The kit of claim 10, wherein the groove is defined by the interior surface of the circular top end, the portion of the side wall, and a first portion of the thread having a substantially constant height from the interior surface of the circular top end, and wherein the groove does not extend along an entire circumference of the side wall.

17. The kit of claim 16, wherein the substantially constant height is about 1.5 mm to about 2 mm.

18. The kit of claim 10, wherein the marker is an end of the thread.

19. A method for performing a magic trick, the method comprising:

placing a first coin and one or more additional coins in a cap;

aligning a marker at a 5 o'clock position in a hand of a user;

sliding the first coin into a groove proximal an interior surface of a top end of the cap; and flipping the cap about 180 degrees, wherein the first coin in the groove is retained in the cap, wherein the one or more additional coins fall out of an open bottom surface of the cap.

20. The method of claim 19, the method further comprising:

instructing an observer to place a hand under the cap prior to flipping the cap about 180 degrees;

allowing the one or more additional coins to fall into the hand of the observer; and asking the observer to count the one or more additional coins.

* * * * *